US008104426B2

(12) United States Patent
Gringer

(10) Patent No.: US 8,104,426 B2
(45) Date of Patent: Jan. 31, 2012

(54) PAINT SHIELD

(75) Inventor: Donald Gringer, New York, NY (US)

(73) Assignee: Allway Tools, Inc., Bronx, NY (US)

( * ) Notice: Subject to any disclaimer, the term of this patent is extended or adjusted under 35 U.S.C. 154(b) by 677 days.

(21) Appl. No.: 12/277,349

(22) Filed: Nov. 25, 2008

(65) Prior Publication Data

US 2010/0126416 A1 May 27, 2010

(51) Int. Cl.
*B05C 21/00* (2006.01)

(52) U.S. Cl. ..... 118/504; 15/144.1; 15/145; 15/236.01; 15/245.1

(58) Field of Classification Search ..... 118/504; 15/236.01, 245.1, 144.1, 145; 427/282; 301/37.103; 294/57, 58; 30/169
See application file for complete search history.

(56) References Cited

U.S. PATENT DOCUMENTS 4,085,703 A * 4/1978 Glowacki ..... 118/504
4,248,914 A * 2/1981 McClane ..... 427/282
4,962,722 A 10/1990 Thompson
6,295,689 B1 * 10/2001 Sciacca ..... 15/245.1
6,905,177 B1 * 6/2005 Murillo ..... 301/37.103

OTHER PUBLICATIONS

"Warner Tool Products. Putting Quality and Innovation in Your hands.", www.warnertool.com., 2008, pp. 19-20.
Allway Tools, Soft Grip Tools for Hard Hat Jobs, 2008, pp. 19.

* cited by examiner

*Primary Examiner* — Laura Edwards
(74) *Attorney, Agent, or Firm* — Gottlieb, Rackman & Reisman, P.C.

(57) ABSTRACT

A paint shield for preventing the misapplication of coating material comprises a shielding member having a leading edge and a base member, an extension handle for enabling a user to hold the leading edge of the paint shielding member against a surface, a pivot member connected to the base member for angularly positioning the shielding member, and a storage location positioned in said base member for storing the pivot member and the extension handle when the pivot member is selectively removed from the base member. The pivot member preferably includes two walls having at least one frictional pad disposed on an inner surface of each wall for frictionally engaging the base member and allowing a user to angularly pivot the shielding member without loosening the pivot member.

21 Claims, 5 Drawing Sheets

FIG. 1
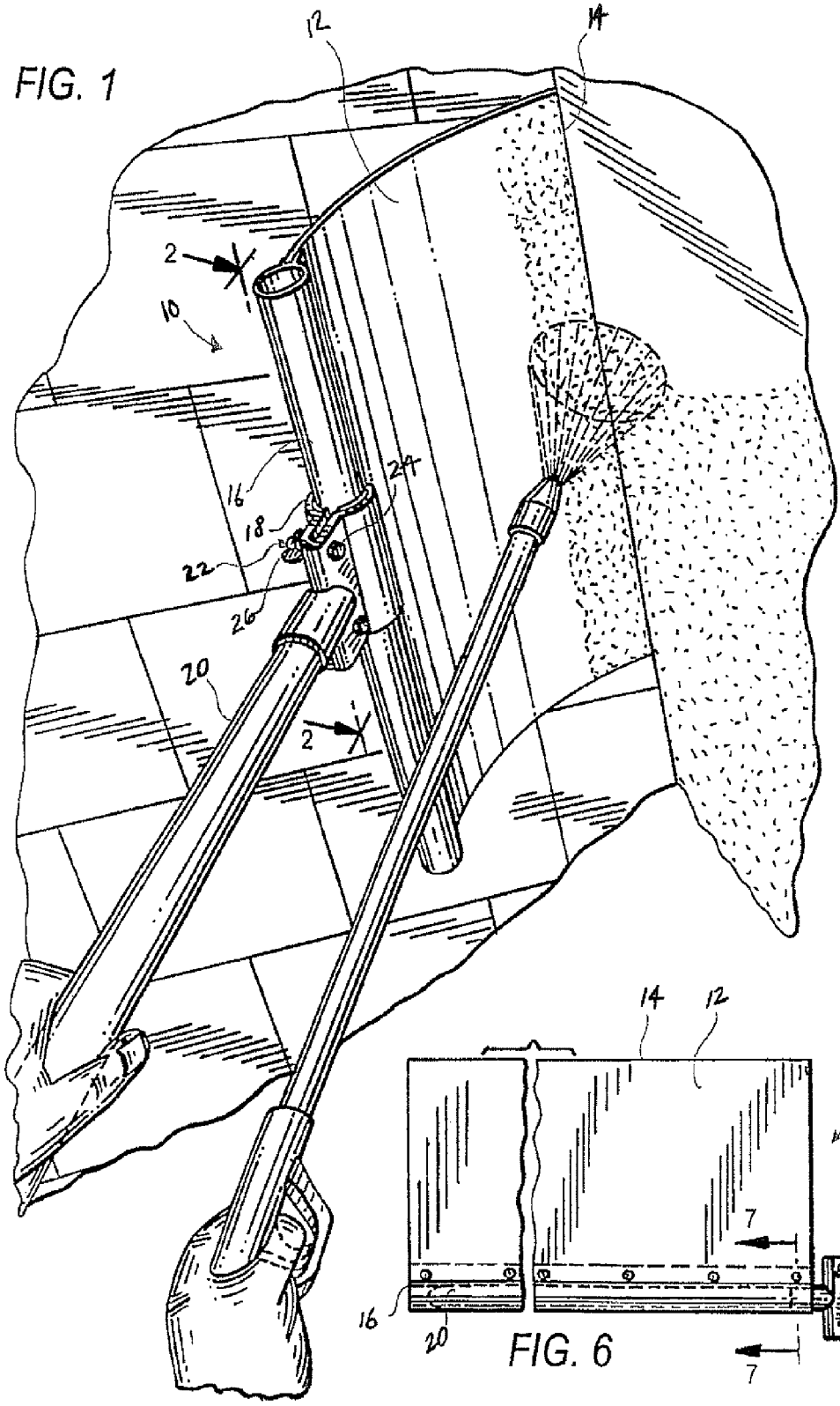
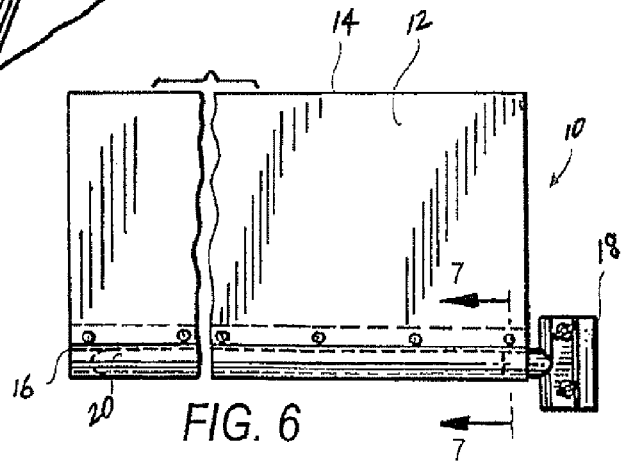
FIG. 6

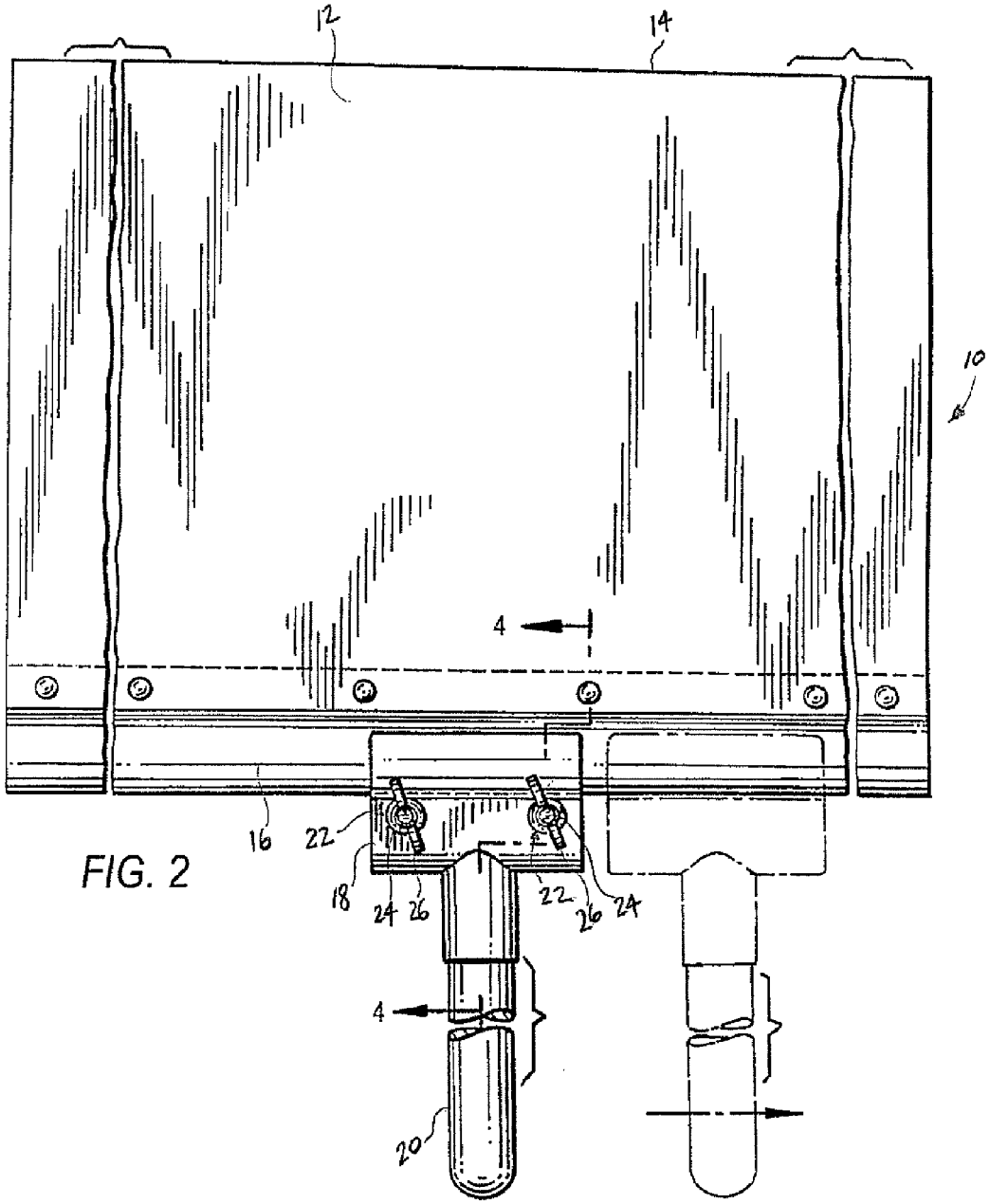
FIG. 2
FIG. 3
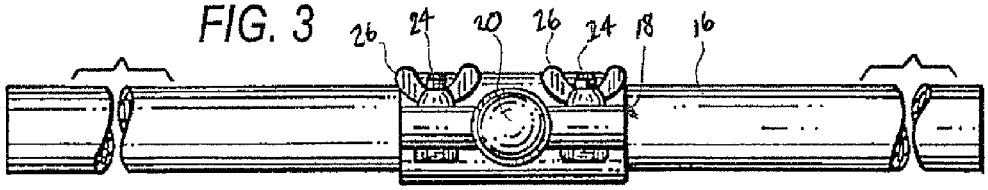

PAINT SHIELD

FIELD OF THE INVENTION

The present invention relates generally to a paint shield that protects a surface from the misapplication of coating materials, such as paint. More particularly, the present invention relates to a paint shield that is easily adjusted for appropriate use, selectively removable and conveniently stored when not in use.

BACKGROUND OF THE INVENTION

Professional and contract painters are typically hired in commercial settings where an entire house, building or other structure must be painted within a predetermined period of time. In these circumstances, it has become common for such painters to employ airless spray painting to accomplish the task. This form of painting utilizes a high-pressure pump that pushes paint through a spray nozzle into a misting shower. Unlike spray guns that are used in conventional automobile and furniture painting, no air is mixed with the paint.

While airless spray painting provides an extremely swift means for coating the surfaces of large structures, it has at least one major drawback. In particular, it is difficult to create or frame a straight line around trim, windows, doors, edges and other adornments due to "over spray" which occurs after paint exits the nozzle of a spray gun. The use of masking tape and plastic or paper sheeting to form a protective film and straighter lines is somewhat effective, but it is also labor intensive. Furthermore, when masking tape is not removed properly, it leaves a residue that is quite sticky and difficult to clean.

To avoid the problems associated with masking tape and to protect a non-designated surface or wall from the misapplication of paint while using a high pressure spray gun, painters have improvised by using spray shields formed with a strip of cardboard, aluminum or other suitable material. However, these are difficult to hold and impossible to extend several feet when painting with a spray gun.

One commercial example of a paint shield is manufactured by Warner Manufacturing Co. of Minneapolis, Minn., as #305 Pro. The device consists of a plastic shield segment or plate which is fixedly secured with a series of fastening screws to a handle. If a user desires to shift the plate so that it fastens to the extension handle at a different location along the length of the plate, the user must remove the fastening screws, reposition the handle or plate relative to one another, and then refasten the plate to the extension handle. Although the Warner paint shield is thus capable of some degree of longitudinal adjustment, it is not capable of any angular or pivotal adjustment, nor is the Warner paint shield capable of being extended without completely separating the handle from the shield plate and then re-attaching the shield plate to a longer handle. Due to these limitations, the device is not particularly versatile when surfaces at different heights and/or varying surface areas and contours need to be painted or otherwise coated.

Another paint shield is disclosed in U.S. Pat. No. 4,962,722 and manufactured by Hyde Manufacturing Co. as the Hyde Tools PROSHIELD™ spray shield. The device includes a plastic plate or blade which is secured to a blade holder. Two hinged components, which permit angular adjustment of the blade, are secured to one another with a selectively releasable hinge fastener. While the device provides for some pivotal adjustment, pivoting while the paint shield is held at an elevated height during use cannot effectively be accomplished. When a user needs the blade to rest at a particular angle, the user must first physically bring down the device down from an elevated height, then loosen the nut or other fastener which is likely covered in wet paint, then reposition the protection blade to the desired angle, and then raise the blade back to a desired height and location. This results in inefficient operation and waste of valuable time, as well as a dirty pair of hands.

Another deficiency in the prior art is that it does not provide for effective storing of the blade, extension handle and/or other parts of the paint shield when a job is finished and the device is no longer in use. When a job is finished, the paint shield must be separated into various constituent parts to make it more compact and easy to travel with. However, by separating the shield from the device, there exists the strong possibility that eventually either the shield portion or other part(s) of the device will be lost, or misplaced or left at a job site.

Thus, despite efforts to provide an effective paint shield for protecting a surface from the misapplication of paint and other coating materials, the prior art paint suffers from a number of deficiencies.

SUMMARY OF THE INVENTION

Accordingly, in view of the deficiencies of the prior art discussed above and other deficiencies not specifically referenced, it is a primary object of the present invention to provide an improved paint shield that allows for pivoting without manual adjustment of a tightening member when the device is in use.

Another object of the present invention to provide an improved paint shield that is effectively adjusted when being utilized at elevated heights or at large distances away from the user.

A further object of the present invention is to provide an improved paint shield that provides for efficient storage when the apparatus is not in use.

Another object of the present invention is to provide an improved paint shield that is sold and kept as a single unit during both use and storage.

Additional objectives will be apparent from the description of the invention that follows.

In summary there is provided a paint shield comprising a shield member incorporating a leading edge and a base member, an extension handle that enables a user to hold the leading edge of the shield member against a painting surface, a pivot member connected to the base member for angularly positioning or pivoting the extension handle relative to the shield member, and a storage location for storing the pivot member and the extension handle when the pivot member is selectively removed from the base member.

These and other aspects of the invention, together with features and advantages thereof, will become apparent from the following detailed description of a preferred embodiment, when taken in conjunction with the accompanying drawings.

BRIEF DESCRIPTION OF THE DRAWINGS

With reference to the attached drawings:

FIG. 1 is a perspective view of a preferred embodiment of the paint shield of the present invention protecting a surface from the paint stream propelled by an airless sprayer;

FIG. 2 is an elevational view of the paint shield with the adjustable pivot member being shown in alternate positions relative to the base member;

FIG. 3 is a bottom view of the paint shield showing the base member, pivot member and tightening member;

FIG. 6 is an elevational view of the paint shield with the extension handle being stored within a storage cavity of the base member;

DETAILED DESCRIPTION OF THE INVENTION

Figure 4:
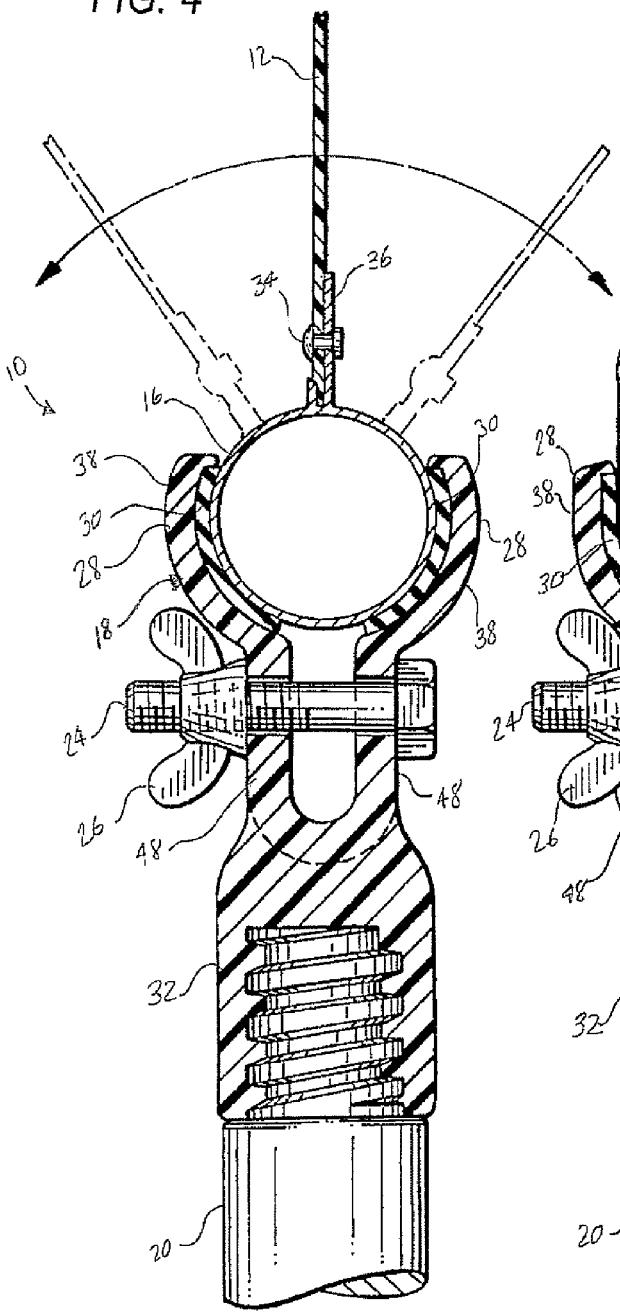
FIG. 4 is a cross sectional view taken along lines 4-4 of FIG. 2 showing the base member and shield member pivoting or rotating within the pivot member.

With reference to FIGS. 1 through 10, there is shown and described an improved paint shield 10. FIG. 1 illustrates a user utilizing the paint shield 10 of the present invention to protect a surface from misapplication of paint or other coating material. More particularly, the paint shield 10 includes a paint shielding member or shield portion 12 having a leading edge 14 and a base member 16. The paint shielding member 12 is preferably formed of a flexible and bendable plastic. Alternatively, a paint shielding member may also be made of a flexible and bendable metal, cardboard, or other suitable material(s) without diverging from the spirit and scope of the present invention. With respect to the base member 16, a pivot member 18 attached to an extension handle or pole 20 is connected to the base member 16. By utilizing the extension handle 20, the user is able to position the paint shielding member 12 between two adjoining surfaces, thereby defining a boundary between a designated surface and a non-designated surface. Once the paint shield 10 is properly positioned, a high-pressure spray nozzle is operated by the user to coat the designated surface with a coating material, such as paint, while the paint shield 10, and more specifically the paint shielding member 12, protects the non-designated surface from over spray, dripping or splatters.

FIGS. 2 and 3 illustrate the preferred embodiment of the paint shield 10 with the adjustable pivot member 18 being longitudinally repositioned along the length of the base member 16. The pivot member 18 is preferably formed of a hard plastic or polypropylene material, but it should be understood that other suitable materials may be utilized to construct a pivot member. In a situation where a user desires to longitudinally reposition the pivot member 18 relative to the base member 16, the user adjusts or loosens a pair of tightening members 22—each preferably comprising a bolt 24 and wingnut 26 combination—that are provided on the pivot member 18. As can be seen more clearly in FIG. 4, loosening of the tightening members 22 permit the walls 28 of the pivot member 18 to further separate from each other, allowing the base 16 or pivot member 18 to slide relative to one another. The walls 28 are responsible for providing varying degrees of frictional engagement between the pivot member 18 and the base member 16. In the preferred embodiment, the walls 28 of the pivot member 18 have an upper portion 38 and a lower portion 48. Preferably, the tightening members 22 secure the base member 16 by engaging the walls 28 at the lower portion 48, allowing the base member 16 to reside above. The tightening members 22 and walls 28 regulate the frictional engagement of the pivot member 18 with respect to the base member 16. In this configuration, the wing nut 26 and the tightening bolt 24 can be adjustably tightened or loosened by turning the wing nut 26 in a clockwise or counter clockwise direction. As further illustrated in FIGS. 2 and 3, the pivot member 18 is typically positioned at the center of the base member 16. However, when a user desires to change the orientation of the pivot member 18, the user is able to loosen the frictional engagement of the pivot member 18 by utilizing the method discussed above. Once the degree of frictional engagement is adjusted by loosening the tightening members 22, the user is able to reposition the pivot member 18 to a more desirable position as illustrated in FIG. 2. In this regard, the base member 16 and shield 12 are able to freely rotate to an appropriate and desired position limited by the walls 28 on either side of the shield 12. It should be understood that the tightening members 22 need not necessarily be independently loosened to remove the pivot member from the base member. It should also be understood that an aperture (not shown) may be provided where the shield 12 meets the base member 16 such that the walls 28 do not necessarily limit how much the base member 16 and shield may be rotated relative to the pivot member 18.

As further shown in FIG. 4 in more detail, the pivot member 18 has walls 28, the upper portion 38 of which include a pair of gripping members 30 that aid in the frictional engagement of the base member 16. In the preferred embodiment, the pivot member 18 also has a neck member 32 for receiving an extension handle 20. As referenced above, the pivot member 18 is constructed and arranged to receive a tightening members 22 for adjusting the frictional engagement between the pivot member 18 and the base member 16. As illustrated in more detail in FIG. 4, the lower portion 48 of the walls 28 includes at least one hole for receiving the tightening bolt 24, wherein one end of the tightening bolt 24 abuts against the outer surface of the wall 28 with the other end extending outwardly to receive the wing nut 26. Thus, the method for providing frictional engagement between the pivot member 18 and the base member 16 is accomplished by the above bolt and wing nut configuration. Although a wing nut 26 and a tightening bolt 24 are used by the present invention for providing the means for regulating and adjusting the frictional engagement of the pivot member 18, other means for tightening or loosening the tightening member 14 are also contemplated without diverging from the present invention. It should also be understood that tightening members may not even be needed where the walls are sufficiently firm and close enough to one another to prevent the base member from becoming inadvertently detached.

Referring again to FIG. 4, the pivot member 18 includes two gripping members or friction pads 30 as previously discussed. Each provides frictional engagement to the outer surface of the base member 16 In a preferred embodiment, the friction pads 30 are made of a thermoplastic elastomer material, preferably Santoprene®. However, the friction pads 30 could be made from other similar materials without diverging from the present invention. Since the pivot member 18 is constructed from polypropylene, the walls 28 are semi-flexible because of the inherent characteristics of polypropylene. Therefore, when a user tightens the tightening members 22, the walls 28 and hence the friction pads 30 will begin to contract inwardly towards one another. As the walls 28 contract inwardly, the friction pads 30 disposed on the inner surface press against the outer surface of the base member 16 to provide frictional engagement. Thus, the combination of the tightening members 22, walls 28 and pads 30 facilitate the connection and frictional engagement between the pivot member 18 and the base member 16.

In a preferred embodiment of the present invention, the walls 28 essentially define a generally U-shaped (or C-shaped) clamp and the shape of the base member 16 is defined as being cylindrical as illustrated in FIG. 4. In this embodiment, the clamp is shaped and sized to conform to the outer surface of the cylindrical base member 16.

Although the walls 28 and the friction pads 30 frictionally secure the pivot member 18 to the cylindrical base member 16, the friction pads 30 nevertheless still allow a user to angularly pivot the extension handle 20 relative to the paint shielding member 12 with the application of some force, but without necessarily loosening the tightening members 22. This is a significant feature of the paint shielding apparatus 10 in that it permits the user to angularly pivot the paint shielding member 12 in various angles while simultaneously using a high-pressure spraying device. Thus, a user can angularly pivot the paint shielding member 12 without being required to first loosen the tightening members 22, thereby avoiding having to stop painting, resetting the device and getting dirty or covered with wet paint.

Referring to the paint shielding member 12, the paint shielding member 12 and base member 16 form a two-piece configuration as illustrated in FIG. 4. The paint shielding member 12 has at least one hole disposed on the opposite side of the leading edge 14, and is constructed and arranged to align with hole(s) disposed on a supporting lip 36 of the base member 16. Once the holes of the paint shielding member 12 and the supporting lip 36 align, a securing bolt 34 is used to fasten the paint shielding member 12 to the base member 16, thus forming a two-piece configuration.

In an alternative embodiment of the paint shielding member (not shown), the paint shielding member and the base member form a one-piece configuration. In this specific embodiment, the edge opposite of the leading edge of the paint shielding member is co-molded with the base member. In such an embodiment, the edge opposite the leading edge begins to form the cylindrical base member and thereafter terminates with a supporting lip. It should also be understood that the paint shield member and base can alternatively be formed by attaching them to one another by other conventional means known to those skilled in the art, or formed as a single integral unit by extrusion or other means.

Figure 5:
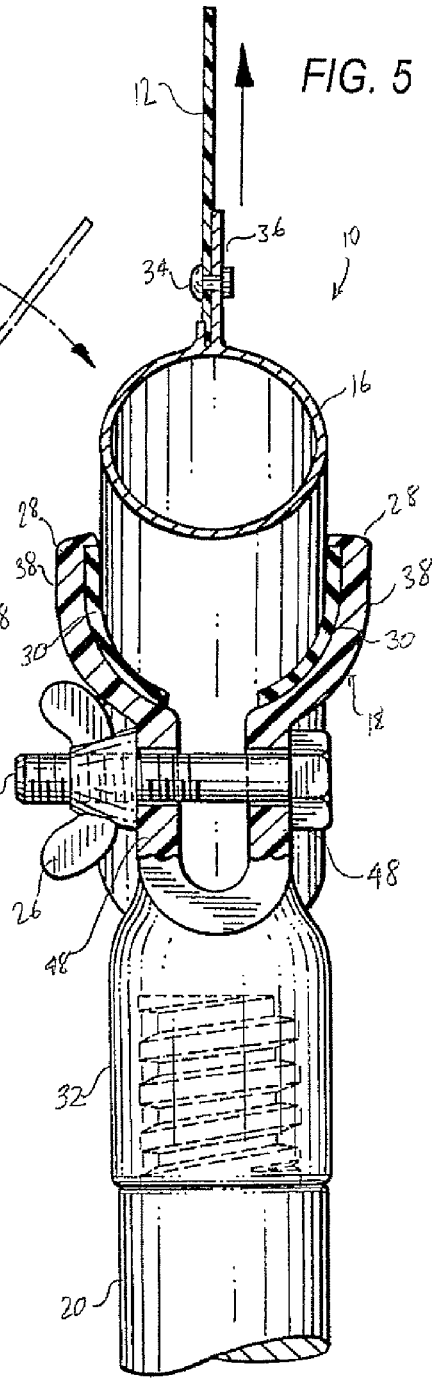
FIG. 5 is a partial cross sectional view, showing two gripping members and walls of the pivot member flex outwardly when the base member is tilted forward as it is selectively removed from the pivot member.

Referring to FIGS. 4 and 5, the neck member 32 of the pivot member 18 is constructed to receive an extension handle or pole 20. The neck member 32 is constructed with a threaded female insert, which is adapted to receive one end of the extension handle 20 disposed with a threaded male insert. Once the extension handle 20 is attached to the neck member 30, the user is able to use the present paint shielding apparatus 10 to protect a non-designated surface from misapplication of coating material by positioning the leading edge 14 of the paint shielding member 12 between two adjoining surfaces. Additionally, the user is able to attach or remove the extension handle 20 when he/she desires by screwing and unscrewing the extension handle 20 from the neck member 32 for storing the extension handle 20 in a storage location, which will be further described in more detail below.

Figure 8:
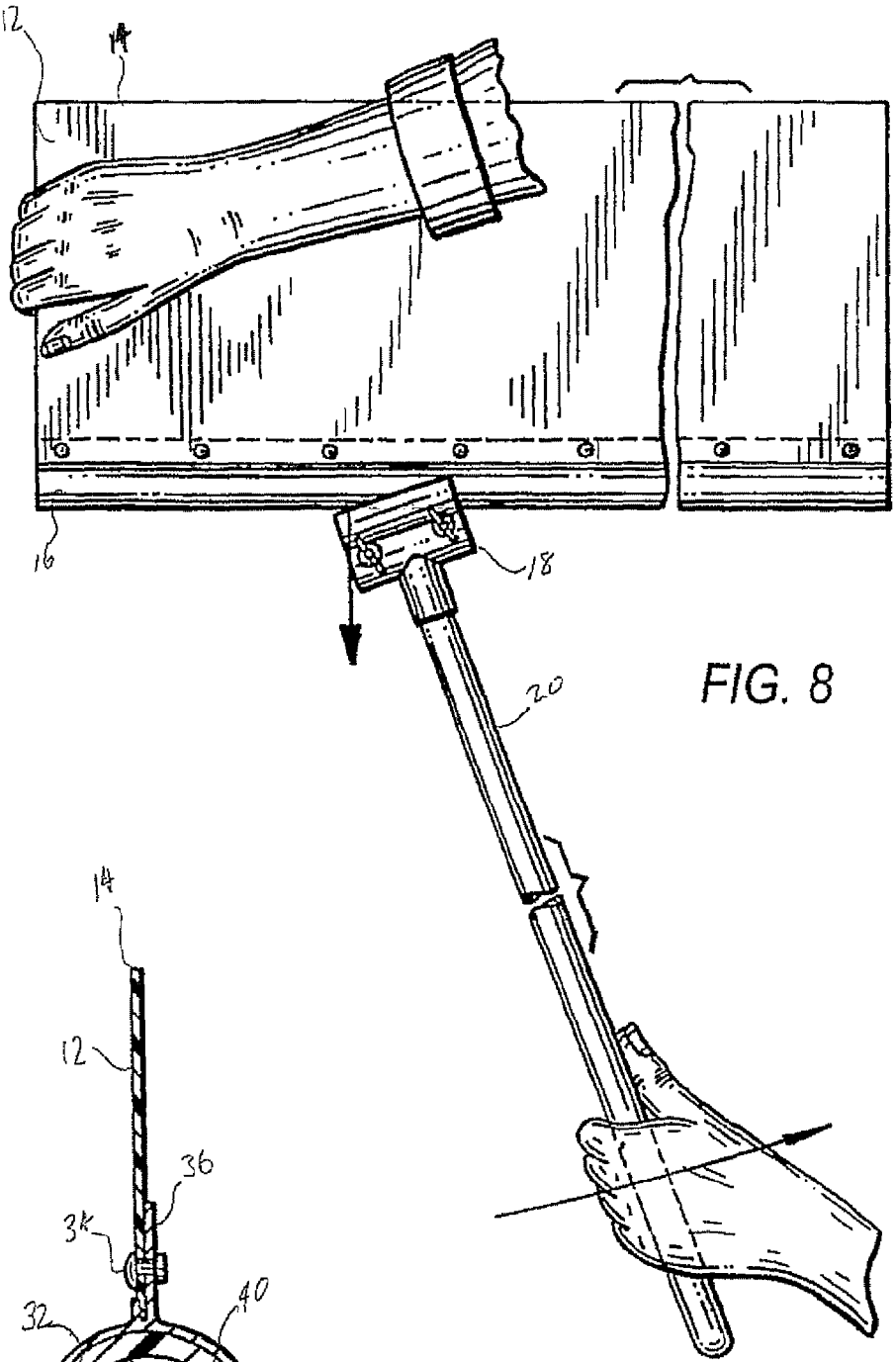
FIG. 8 is an elevational view of the paint shield with the shield member and base member being selectively removed from the pivot member.

As illustrated best in FIGS. 5 and 8, the base member 16 is adapted to be selectively removed from the pivot member 18. The walls 28 are made from polypropylene, which allows them to have flexible characteristics. When receiving the base member 16, the walls 28 are adapted to flex outwardly. Conversely, the gripping walls 28 flex outwardly when the base member 16 is selectively removed as shown in FIG. 5. The advantage of the present invention allows the pivot member 18 to be selectively removed from the base member 16 without loosening the tightening members 22 by pulling the paint shielding member 12 and the extension handle 20 in opposite directions as illustrated in FIG. 8. Thus, not only do the walls 28 of the present invention facilitate the connection between the pivot member 18 and the base member 16, but the walls 28 include flexible characteristics that allow the pivot member 18 to be selectively removed from the base member 16 without having to adjust the tightening members 22.

Once the user successfully removes the pivot member 18 from the base member 16, the user is provided with a storage location for the pivot member 18 and the extension handle 20. In this embodiment, the base member 16 forms a cylindrical shape with the inside being hollow for defining the storage location or cavity 40. The storage location 40 is constructed to store the neck member 32 and the extension handle 20 as shown in FIG. 6. By providing a storage location 40, the paint shield 10 can be easily carried and/or stored when not in use.

Figure 7:
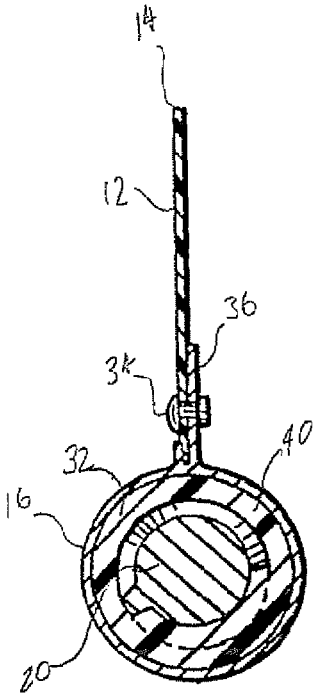
FIG. 7 is a cross sectional view taken along lines 7-7 of FIG. 6 showing the extension handle being stored within a storage cavity of the base member.

More particularly and further illustrated in FIG. 7, the neck member 32 is also cylindrically shaped, with an outer surface that is slightly smaller than the inner surface of the cylindrical base member 16. Since the neck member 32 has a circumference and diameter that is only slightly smaller than those of the cylindrical base member 16, the outer surface of the neck member 32 frictionally engages the inner surface of the cylindrical base member 16, thereby steadily securing the pivot member 18 and the associated extension handle 20 within the cylindrical base member 16. It should be understood that the degree of friction between the neck member 32 and base 16 is not extreme, but sufficient to keep the neck member 32 from inadvertently sliding out of the cavity 40. Thus, it is advantageous for the base member 16 to be constructed with a storage location 40 to keep all disassembled parts as one integral apparatus to avoid misplacement of the pivot member 18 and the extension handle 20 when not in use.

Figure 9:
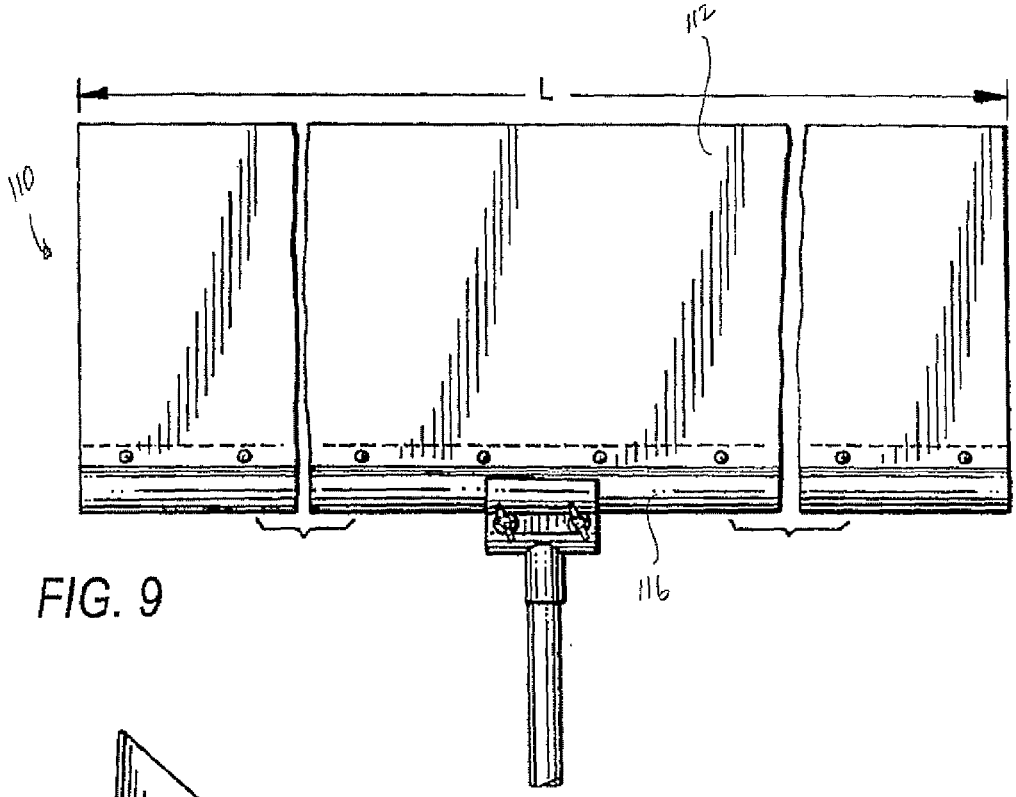
FIG. 9 is a perspective view of an alternate embodiment of the paint shield showing a paint shielding member of a greater length.

Up until now the paint shielding member and the base member have been illustrated to show only one size. However, it should be understood that the paint shielding member and the base member are not limited as such and can include varying sizes as illustrated in FIG. 9. FIG. 9 illustrates a larger paint shielding member 112 and a larger base member 116 for allowing a wider range of protection of a non-designated surface. In this alternative embodiment, the larger paint shielding member 112 can be constructed to be longer in both length and height. Similarly, the larger base member 116 can be constructed to be longer in length to accommodate the larger paint shielding member 112. Therefore, a user of the paint shielding apparatus 110 is provided with an apparatus that can protect a wider area of a non-designated surface from misapplication of coating material. Due to the weight of the materials and gravitational forces that can fatigue the user when the device is being used, the paint shield apparatus of the present invention is preferably constructed with a length of about 24"-48" from end to end, and 12"-24" from leading edge to base. However it should be understood that different lengths may be utilized. It should also be understood that the paint shield member may incorporate many geometric or other shapes besides the rectangular form shown in the drawings.

Figure 10:
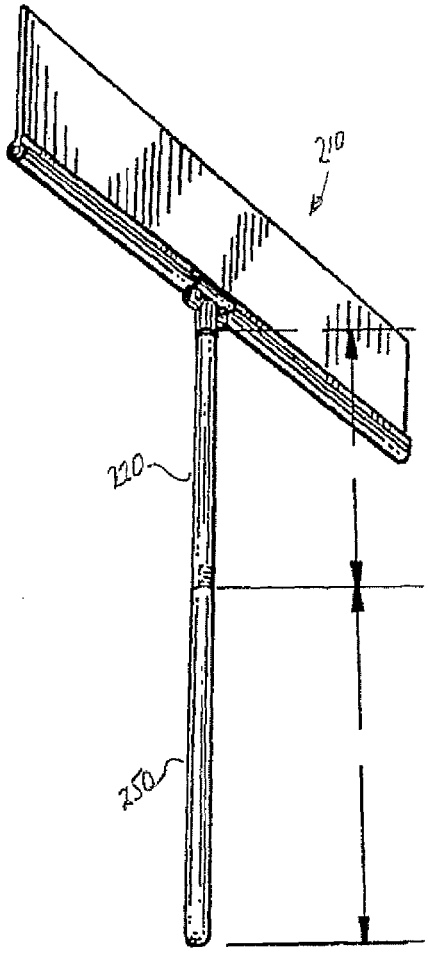
FIG. 10 is a perspective view of the alternate embodiment shown in FIG. 9 having an extension handle.

FIG. 10 illustrates an alternative embodiment of the extension handle 120. In this embodiment, the extension handle 120 includes a threaded female insert disposed on the end opposite of the threaded male insert. The threaded female insert, similar to the threaded female insert of the neck member of the pivot member, is constructed to receive a second extension handle 150. A threaded male insert of the second extension handle 150 is screwed into the threaded female insert of extension handle 120. Thus, this alternative embodiment provides a user with a longer paint shielding apparatus 110 for reaching a surface that was not reachable with only one extension handle.

Although the invention is described in terms of particular embodiments, it is to be understood that the embodiments are merely illustrative of an application of the principles of the invention. It should also be appreciated that numerous modifications may be made and other arrangements may be devised while still keeping within the spirit and scope of the invention.

The invention claimed is:

1. A paint shield comprising:

a shielding member having a leading edge and a base member;

a pivot member having a first end and a second end, wherein said first end is selectively removable from said shielding member at said base member;

an extension handle attached to said second end of said pivot member, said pivot member being angularly positioned relative to said shielding member by said extension handle;

wherein said base member defines a storage location for storing said extension handle and said pivot member after said pivot member has been removed from said shielding member;

wherein said pivot member includes a pair of walls that retain said base member in a selectively rotatable position.

2. The paint shield of claim 1, wherein said walls incorporate a frictional pad to provide frictional engagement between said pivot member and said base member.

3. The paint shield of claim 2, wherein said frictional pad comprises a thermoplastic elastomer.

4. The paint shield of claim 1, wherein said base member is adapted to rotate while being retained by said walls when force is applied by a user through said extension handle.

5. The paint shield of claim 1, wherein said storage location of said base member has an inner surface and said pivot member frictionally engages said inner surface of said storage location for maintaining said pivot member within said storage location.

6. The paint shield of claim 1, wherein said pivot member is longitudinally adjustable relative to said base member.

7. The paint shield of claim 1, wherein said shielding member is flat and bendable.

8. A paint shield comprising:

a shielding member having a leading edge and a base member;

a pivot member having a first end and a second end, wherein said first end is selectively removable from said shielding member at said base member;

an extension handle attached to said second end of said pivot member, said pivot member being angularly positioned relative to said shielding member by said extension handle;

wherein said base member defines a storage location for storing said extension handle and said pivot member after said pivot member has been removed from said shielding member;

wherein said base member has an outer surface and said pivot member includes a pair of gripping walls which engage said outer surface of said base member.

9. The paint shield of claim 8, wherein said gripping walls are flexible.

10. The paint shield of claim 9, wherein said gripping walls flex outwardly to allow said pivot member to be removed from said base member.

11. The paint shield of claim 8, wherein each of said gripping walls includes a friction pad to frictionally engage said outer surface of said base member.

12. The paint shield of claim 11, wherein said friction pads are made of thermoplastic elastomer material.

13. The paint shield of claim 8, wherein said gripping walls define a clamp, said clamp being shaped to conform to the outer surface of said base member.

14. A paint shield comprising:

a shielding member having a leading edge and a base member;

a pivot member having a first end and a second end, wherein said first end is selectively removable from said shielding member at said base member;

an extension handle attached to said second end of said pivot member, said pivot member being angularly positioned relative to said shielding member by said extension handle;

wherein said base member defines a storage location for storing said extension handle and said pivot member after said pivot member has been removed from said shielding member;

wherein said base member is a hollow cylinder.

15. A paint shield comprising:

a shielding member having a cylindrical and hollow base member and a leading edge that defines a boundary between a painting surface and a non-painting surface;

a pivot member, said pivot member being connected to said base member and adapted to rotate around said base member;

a handle, said handle being connected to said pivot member;

a storage location defined in said base member for storing said pivot member and said handle after said pivot member has been removed from said base member.

16. The paint shield of claim 15, wherein said base member includes an outer surface with a supporting lip disposed longitudinally along said outer surface of said base member for supporting said shielding member.

17. The paint shield of claim 16, wherein said shielding member and said supporting lip are secured to one another by at least one securing bolt.

18. The paint shield of claim 17, wherein said shielding member and said base member form a two-piece configuration.

19. The paint shield of claim 15, wherein said base member has an inner surface at said storage location and said pivot member includes a neck member that frictionally engages said inner surface at said storage location for maintaining said pivot member within said storage location.

20. The paint shield of claim 15, wherein base member has an outer surface and said pivot member includes gripping members that define a clamp, said gripping members having at least one friction pad for frictionally engaging and conforming to said outer surface of said base member.

21. The paint shield of claim 20, wherein said at least one friction pad is made of thermoplastic elastomer material.

* * * * *